US005358070A

United States Patent [19]

Bartnicki et al.

[11] Patent Number: 5,358,070

[45] Date of Patent: * Oct. 25, 1994

[54] LADDER TOP

[75] Inventors: Frederick J. Bartnicki, Greenville; Harold L. Bernard, Transfer; Robert Beggs, Fredonia; Donald M. Werner, Hermitage; Dale R. King, Greenville, all of Pa.

[73] Assignee: Werner Co., Greenville, Pa.

[ * ] Notice: The portion of the term of this patent subsequent to Nov. 9, 2010 has been disclaimed.

[21] Appl. No.: 148,389

[22] Filed: Nov. 8, 1993

Related U.S. Application Data

[63] Continuation of Ser. No. 906,587, Jun. 30, 1992, Pat. No. 5,259,480, which is a continuation of Ser. No. 471,129, Jan. 26, 1990, Pat. No. Des. 340,773, which is a continuation-in-part of Ser. No. 100,432, Sep. 24, 1987, Pat. No. Des. 310,884.

[51] Int. Cl.[5] ..... E06C 1/00

[52] U.S. Cl. ..... 182/173; 182/129

[58] Field of Search ..... 182/129, 46, 116, 173, 182/126; 248/210, 238

[56] References Cited

U.S. PATENT DOCUMENTS

| | | | |
|---|---|---|---|
| 1,379,419 | 5/1921 | Reeves | 182/173 X |
| 2,109,886 | 3/1938 | Lewis | 182/129 X |
| 2,425,025 | 8/1947 | Boisselier | 182/129 X |
| 3,010,535 | 11/1961 | Depiano | 182/129 |
| 3,106,987 | 10/1963 | Lerner | 182/126 |
| 4,023,647 | 5/1977 | Confer | 182/46 X |
| 4,261,435 | 4/1981 | Winter | 182/129 |
| 4,601,364 | 7/1986 | York | 182/46 X |
| 4,874,147 | 10/1989 | Ory et al. | 182/129 X |
| 4,979,590 | 12/1990 | Bailey | 182/129 X |
| 5,031,723 | 7/1991 | Hooten | 182/129 |
| 5,259,480 | 11/1993 | Bartnicki et al. | 182/173 |

*Primary Examiner*—Blair M. Johnson
*Attorney, Agent, or Firm*—Ansel M. Schwartz

[57] ABSTRACT

The present invention is a ladder top for a ladder. The ladder top has a top panel having a perimeter. The perimeter has at least a first edge, a second edge, a third edge and a fourth edge. The ladder top also has a first side wall extending in an integral fashion from the first edge, and an opposing second side wall extending in an integral fashion from the second edge. The first side wall has at least one slot through which accessories can be attached. A third side wall extends in an integral fashion from the third edge and in juxtaposition with the first and second side walls. A fourth side wall extends in an integral fashion from the fourth edge and in juxtaposition with the first and second side walls and opposing the third side wall. The ladder is connected to the ladder top through the third and fourth side walls. Preferably, the first side wall has two slots in a spaced relationship with each other. Preferably, the slots are rectangularly shaped with rounded ends. Preferably, the top panel has buttressing integrally joined and extending from its underside for strengthening the top panel.

15 Claims, 3 Drawing Sheets

LADDER TOP

This patent application is a continuation of U.S. patent application Ser. No. 07/906,587, filed Jun. 30, 1992, now U.S. Pat. No. 5,259,480, issued on Nov. 9, 1993; which is a continuation of U.S. patent application Ser. No. 07/471,129 filed on Jan. 26, 1990, now U.S. Pat. No. D340773, issued on Oct. 26, 1993, which is a continuation-in-part of U.S. patent application Ser. No. 07/100,432 filed on Sep. 24, 1987, now U.S. Pat. No. D310884.

FIELD OF THE INVENTION

The present invention is related in general to a ladder system. More specifically, the present invention is related to a ladder top of a ladder having at least one slot disposed on its side wall through which various accessories can be attached to the ladder top.

BACKGROUND OF THE INVENTION

A ladder top provides one of the few horizontal work surfaces upon which a user commonly places various tools and accessories. It is known to provide various openings and recesses in the top surface of ladder tops to secure desired tools such that they do not slide or fall off the top surface. Unfortunately, the area of the top surface of the ladder top is limited in size and thus only so many tools can be placed on it. Accordingly, there is a need for a ladder top which provides more surface area through which openings can be defined for storing and holding tools and accessories. The present invention provides a ladder top with side walls projecting downwardly from the upper surface through which at least one slot is defined for allowing attachment of tools and accessories.

SUMMARY OF THE INVENTION

The present invention pertains to a ladder system. The ladder system comprises at least one set of legs. The system also comprises a top panel having a perimeter. The perimeter has at least a first edge, a second edge, a third edge and a fourth edge. The top panel has a topside and an underside disposed between the first, second, third and fourth edges. The system additionally is comprised of a first side wall extending in an integral fashion from the underside along the first edge, the first side wall having at least one slot through which accessories of the ladder can be attached. There is an opposing second side wall extending in an integral fashion from the underside along the second edge. There is a third side wall extending in an integral fashion from the underside along the third edge and in juxtaposition with the first and second side walls. There is also a fourth side wall opposing the third side wall and extending in an integral fashion from the underside along the fourth edge and in juxtaposition with the first and second side walls. The at least one set of legs is attached to the ladder top through the third and fourth side walls.

In a preferred embodiment, the top panel has a topside with a grid of ridges integrally formed on the topside of the top panel and extending outwardly therefrom and the top panel includes a plurality of holes arranged in a spaced relationship. The topside of the top panel can include a recess having a circular shaped periphery and a flat base. Preferably, the second side wall includes a hook extending out therefrom.

Preferably, the top panel has an underside and buttressing integrally joined and extending from the underside and connected to the first and second walls for strengthening the top panel. Preferably, the buttressing has a first leg and a second leg forming a first pair of legs, and a third leg and a fourth leg forming a second pair of legs which extend from the first and second side walls, respectively, and intersect to form an X shape. A portion of the first leg and a portion of the second leg have a first height as measured from the underside of the top panel such that the portion of the first leg and the second leg having the first height extends from the first side wall past the respective slot after which point the first and second legs have a second height, which is greater than said first height, along the remainder of their length. The first height is less than a height, as measured from the underside of the top panel, of a portion of the slot closest to the underside of the top panel. The buttressing can also include a curved arch which integrally forms and extends from the underside and which extends between the first and second legs and connects thereto at the respective point where the second height of the respective leg begins. Preferably, the top panel, hook, buttressing, first, second, third and fourth side walls are one continuous piece.

BRIEF DESCRIPTION OF THE DRAWINGS

In the accompanying drawings, the preferred embodiment of the invention and preferred methods of practicing the invention are illustrated in which.

DESCRIPTION OF THE PREFERRED EMBODIMENT

Figure 1:
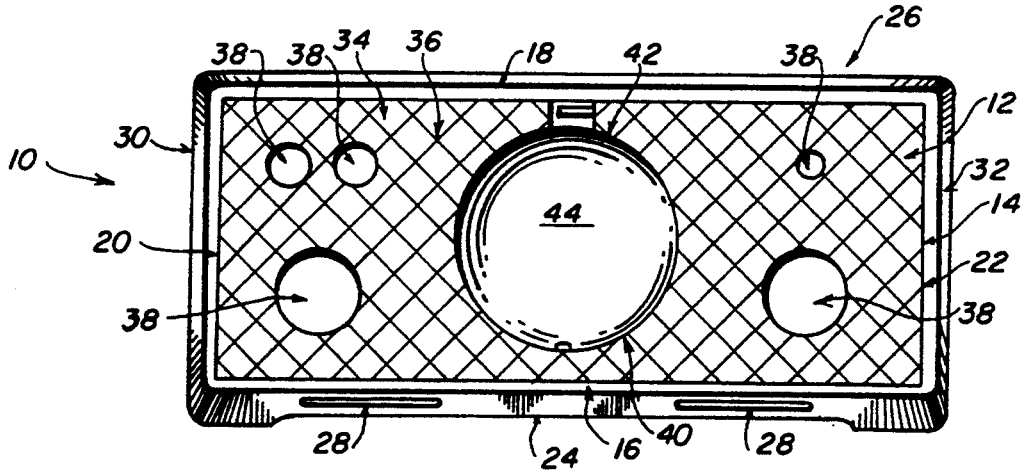
FIG. 1 is a schematic representation showing a top view of the ladder top.
Figure 2:
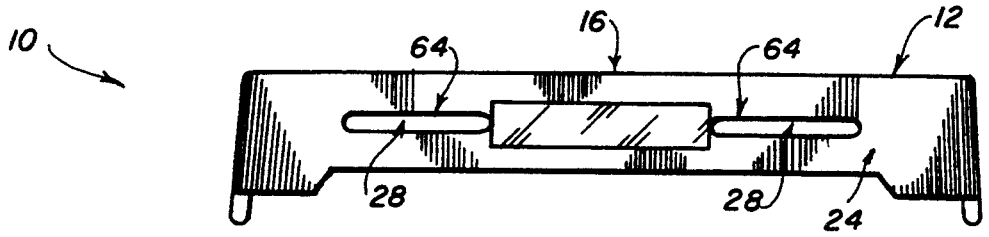
FIG. 2 is a schematic representation showing a front view of the ladder top.
Figure 4:
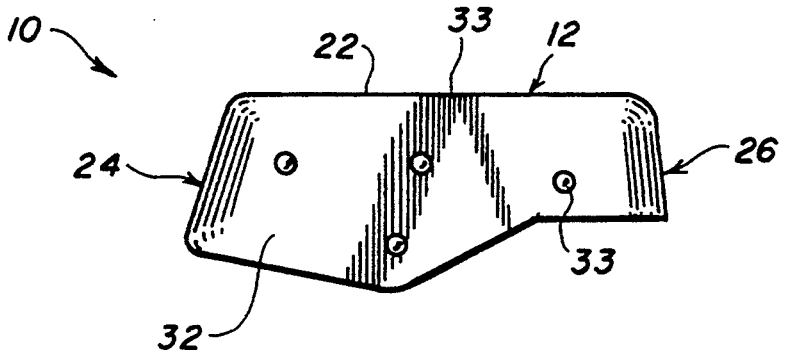
FIG. 4 is a schematic representation showing a side view of the ladder top.
Figure 6:
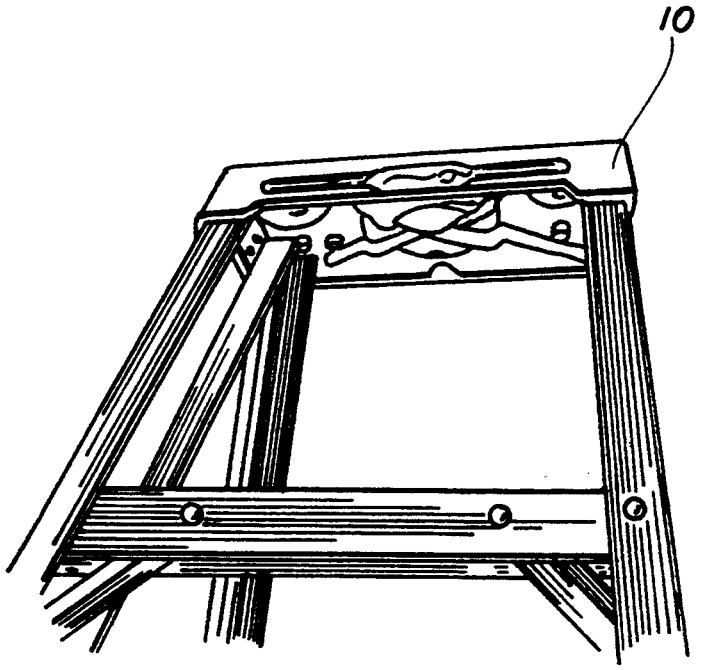
FIG. 6 is a perspective view of a ladder.

The present invention is a ladder system. The ladder system is comprised ladder top 10 for a ladder (not shown). The ladder top 10 has a top panel 12 having a perimeter 14. The perimeter 14 has at least a first edge 16, a second edge 18, a third edge 20 and a fourth edge 22. The ladder top 10 also has a first side wall 24 extending in an integral fashion from the first edge 16, and an opposing second side wall 26 extending in an integral fashion from the second edge 18. The first side wall 24 has at least one slot 28 through which accessories can be attached. A third side wall 30 extends in an integral fashion from the third edge 20 and in juxtaposition with the first and second side walls 24, 26. A fourth side wall 32 opposing the third side wall 30 extends in an integral fashion from the fourth edge 22 and in juxtaposition with the first and second side walls 24, 26. The ladder is connected to the ladder top 10 through the third and fourth side walls 30, 32, preferably, with screws through holes 33 as shown in FIGS. 4 and 6. Preferably, the first side wall has two slots 28 in a spaced relationship with each other as shown in FIG. 2. Preferably, the slots 28 are rectangularly shaped with rounded ends.

Figure 3:
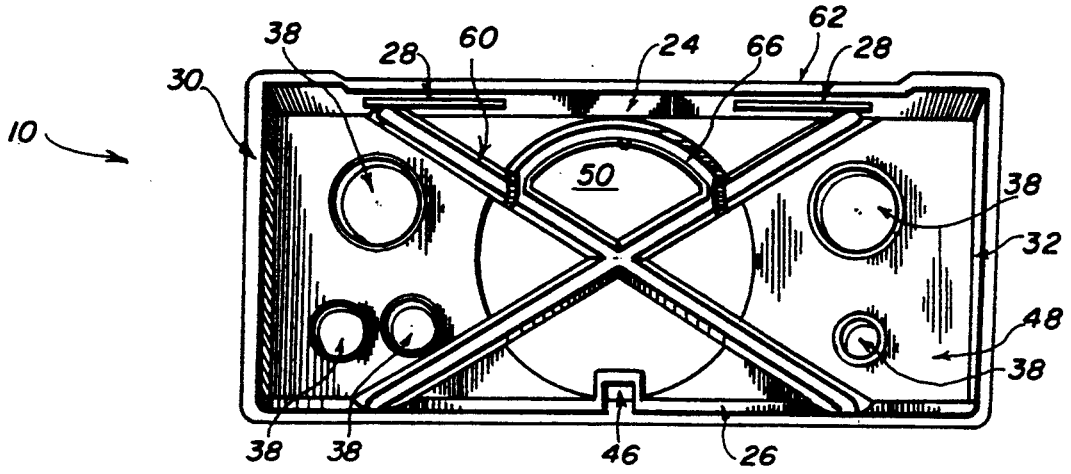
FIG. 3 is a schematic representation showing a bottom view of the ladder top.
Figure 5:
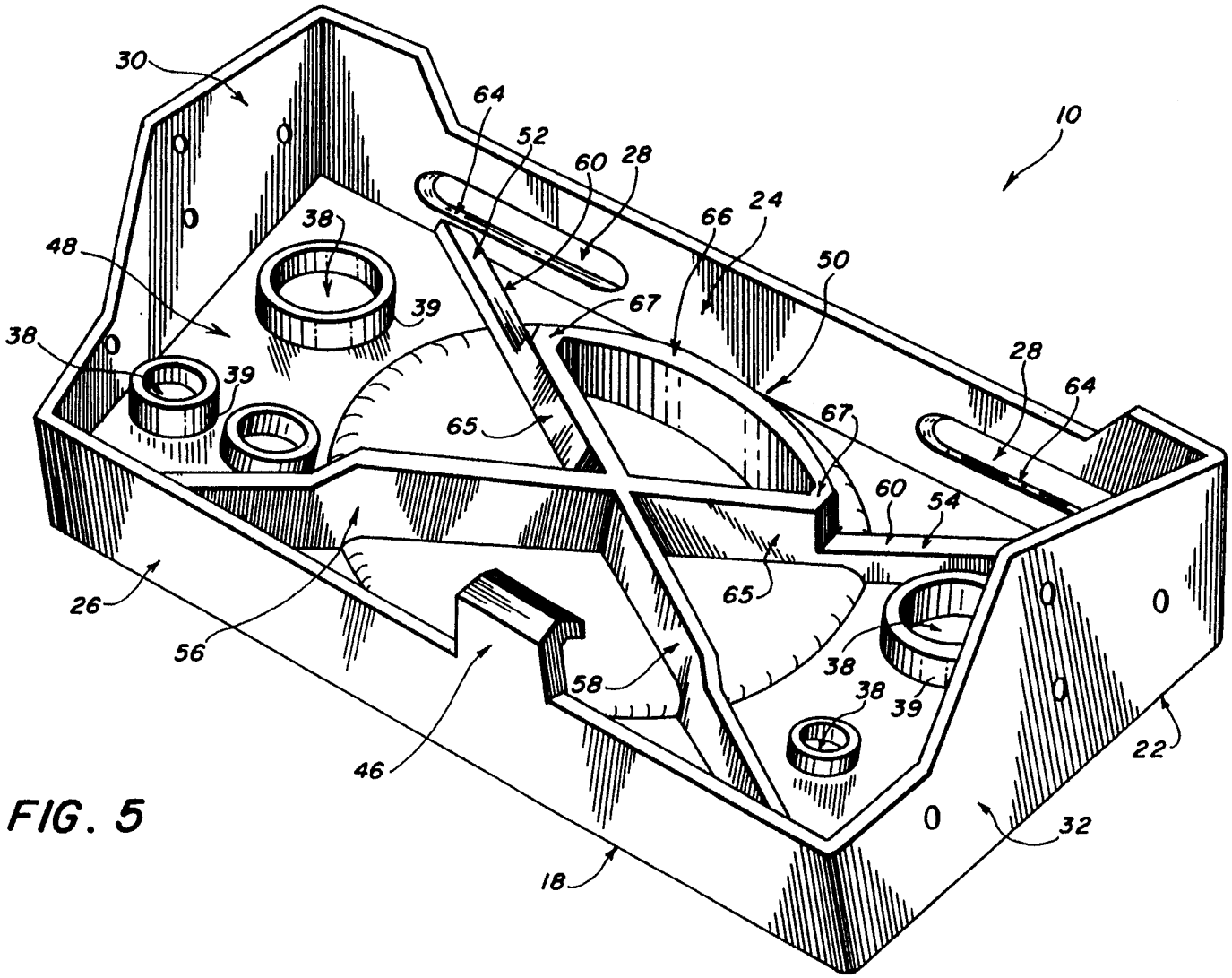
FIG. 5 is a schematic representation showing a perspective view of the ladder top.

In a preferred embodiment, the top panel 12 has a topside 34 with a grid of ridges 36 integrally formed on the topside 34 of the top panel 12 and extending outwardly therefrom and the top panel 12 includes a plurality of holes 38 arranged in a spaced relationship for holding various tools, for example. The topside 34 of the top panel 12 can include a recess 40 having a circular shaped periphery 42 and a flat base 44. Preferably, the second side wall 26 includes a hook 46 extending therefrom as shown in FIG. 3 and FIG. 5.

Preferably, the top panel 12 has an underside 48 and buttressing 50 integrally joined and extending from the underside 48 and preferably connected to the first and second walls 24, 26 for strengthening the top panel 12. Preferably, the buttressing 50 has a first leg 52 and a second leg 54 forming a first pair of legs, and a third leg 56 and a fourth leg 58 forming a second pair of legs which extend from the first and second side walls 24, 26, respectively, and intersect to form an X shape. A portion 60 of the first leg 52 and a portion 62 of the second leg 54 have a first height as measured from the underside 48 of the top panel 12 such that the portions 60, 62 of the first leg and the second leg having the first height extend from the first side wall 24 past their respective slot 28 after which point the first and second legs 52, 54 have a second height along first leg second portion 63 and second leg second portion 65, respectively, which is greater than the first height, along the remainder of their length. The first height is less than a height, as measured from the underside 48 of the top panel 12, of a portion 64 of the slots 28 closest to the underside 48 of the top panel 12. The second pair of legs have a height preferably at the second height.

The buttressing 50 preferably includes a curved arch 66 which integrally extends from the underside 48 and which extends between the first and second legs 52, 54 and connects thereto at the respective point 67 where the second height of the respective leg begins. Preferably, the top panel 12, hook 46, buttressing 50, first 24, second 26, third 30 and fourth 32 side walls are one continuous piece. Each of the holes 38 can have cylindrical shells 39 which extend from the underside 48 of the top panel 12 to form channels for objects that are placed therein.

In the operation of the ladder top 10, the user sets up a ladder with the ladder top 10 disposed on top at a desired location. The user collects the various tools and accessories needed to perform the job at hand and places them within the holes 38 and slots 28 of the ladder top 10. The slots 28 disposed in the first side wall 24 allow the ladder top 10 to hold more tools and accessories within reach of the user than would otherwise be provided by the top panel 12 alone. For instance, the slots 28 on the first side wall 24 can be used to engage with protrusions on a container (not shown) which holds and spreads paint for a roller. Accordingly, the user can finish the job at hand in less time and more effectively since he does not have to dismount the ladder to collect tools.

With reference to FIG. 6 and FIG. 5, there is shown a ladder system. The ladder system comprises at least one set of legs. The system also comprises a top panel 12 having a perimeter 14. The perimeter 14 has at least a first edge 16, a second edge 18, a third edge 20 and a fourth edge 22. The top panel 12 has a topside and an underside 48 disposed between the first, second, third and fourth edges. The system additionally is comprised of a first side wall 24 extending in an integral fashion from the underside 48 along the first edge 16. The first side wall 24 has at least one slot 28 through which accessories of the ladder can be attached. There is an opposing second side wall 26 extending in an integral fashion from the underside 48 along the second edge 18. There is a third side wall 30 extending in an integral fashion from the underside 48 along the third edge 20 and in juxtaposition with the first and second side walls. There is also a fourth side wall 32 opposing the third side wall 30 and extending in an integral fashion from the underside 48 along the fourth edge 22 and in juxtaposition with the first and second side walls. The third and fourth side walls preferably have holes through which at least one set of legs is attached to the ladder top.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

What is claimed is:

1. A ladder system comprising:

at least one set of legs;

a top panel having a perimeter, said perimeter having at least a first edge, a second edge, a third edge and a fourth edge, said top panel having a topside and an underside disposed between the first, second, third and fourth edges; and a first side wall extending in an integral fashion from the underside along the first edge, the first side all having at least one slot through which accessories of the ladder can be attached, an opposing second side wall extending in an integral fashion from the underside along the second edge, a third side wall extending in an integral fashion from the underside along the third edge an din juxtaposition with the first and second side walls, and a fourth side wall opposing said third side wall and extending in an integral fashion from the underside along the fourth edge an din juxtaposition with the first and second side walls, said at least one set of legs attached to the ladder top through the third and fourth side walls.

2. A ladder system as described in claim 1 wherein the third and fourth side walls having holes through which the at least one set of legs is attached to the ladder top.

3. A ladder system as described in claim 2 wherein the first side wall has two slots.

4. A ladder system as described in claim 3 wherein said slots are disposed in a spaced relationship with each other.

5. A ladder system as described in claim 4 wherein said slots are rectangularly shaped with rounded ends.

6. A ladder system as described in claim 5 wherein said top panel has a topside with a grid of ridges integrally formed on said topside of said top panel and extending outwardly therefrom.

7. A ladder system as described in claim 6 wherein the top panel includes a plurality of holes arranged in a spaced relationship.

8. A ladder system as described in claim 7 wherein the topside of the top panel includes a recess having a circular shaped periphery and a flat base.

9. A ladder system as described in claim 8 wherein the second side wall includes a hook extending therefrom.

10. A ladder system as described in claim 9 wherein said top panel has an underside and buttressing integrally joined and extending from said underside and connected to said first and second walls for strengthening the top panel.

11. A ladder system as described in claim 10 wherein said buttressing has a first leg and a second leg forming a first pair of legs, and a third leg and a fourth leg forming a second pair of legs which extend from said first and second side walls, respectively, and intersect to form an X shape, a portion of said first leg and a portion of said second leg have a first height as measured from the underside of the top panel such that the portion of the first leg and the second leg having the first height extends form said first side wall past the respective slot after which point the first and second legs have a second height, which is greater than said first height, along the remainder of their length, said first height less than a height, as measured from the underside of the top panel, of a portion of a slot closest to the underside of the top panel.

12. A ladder system as described in claim 11 wherein said buttressing includes a curved arch which integrally extends from said underside and which extends between the first and second legs and connects thereto at the respective point where the second height of the respective leg begins.

13. A ladder system as described in claim 12 wherein the recess is disposed essentially in the center of the topside of the top panel.

14. A ladder system as described in claim 13 wherein the third side wall is integrally connected to the first and second side walls and the fourth side wall is integrally connected to the first and second side walls.

15. A ladder system as described in claim 14 wherein the top panel, hook, buttressing, first, second, third and fourth side walls are one continuous piece.

* * * * *

UNITED STATES PATENT AND TRADEMARK OFFICE

CERTIFICATE OF CORRECTION

PATENT NO. : 5,358,070

DATED : October 25, 1994

INVENTOR(S) : Frederick J. Bartnicki, et. al.

It is certified that error appears in the above-indentified patent and that said Letters Patent is hereby corrected as shown below:

Column 4, lines 37 and 41, change "an din" to -- and in --.

Signed and Sealed this

Thirtieth Day of May, 1995

*Attest:*

Bruce Lehman

BRUCE LEHMAN

*Attesting Officer*

*Commissioner of Patents and Trademarks*